US006558338B1

(12) United States Patent
Wasserman

(10) Patent No.: US 6,558,338 B1
(45) Date of Patent: May 6, 2003

(54) SYSTEM FOR AND METHOD OF APPLYING PRESSURE TO HUMAN BODY

(75) Inventor: Zvi Wasserman, Doar Afek (IL)

(73) Assignee: Mego Afek Industrial Measuring Instruments, Doar Afek (IE)

( * ) Notice: Subject to any disclaimer, the term of this patent is extended or adjusted under 35 U.S.C. 154(b) by 0 days.

(21) Appl. No.: 09/715,051

(22) Filed: Nov. 20, 2000

(51) Int. Cl.[7] ..... A61H 9/00
(52) U.S. Cl. ..... 601/152
(58) Field of Search ..... 601/148–149, 601/150–152, 41, 44; 606/201, 202; 128/DIG. 20; 602/13

(56) References Cited

U.S. PATENT DOCUMENTS

| | | | | |
|---|---|---|---|---|
| 3,837,336 A | | 9/1974 | Taubert | |
| 4,013,069 A | * | 3/1977 | Hasty | 601/152 |
| 4,338,923 A | | 7/1982 | Gelfer et al. | |
| 4,865,020 A | | 9/1989 | Bullard | |
| 4,941,458 A | | 7/1990 | Taheri | |
| 5,014,681 A | * | 5/1991 | Heeman et al. | 601/152 |
| 5,117,812 A | * | 6/1992 | McWhorter | 601/149 |
| 5,383,894 A | | 1/1995 | Dye | |
| 5,437,610 A | | 8/1995 | Cariapa et al. | |
| 5,591,200 A | | 1/1997 | Cone et al. | |
| 5,626,556 A | | 5/1997 | Tobler et al. | |
| 5,830,164 A | * | 11/1998 | Cone et al. | 601/152 |
| 5,843,007 A | * | 12/1998 | McEwen et al. | 601/152 |
| 5,968,073 A | | 10/1999 | Jacobs | |

FOREIGN PATENT DOCUMENTS

EP 1 018 329 A2 7/2000

OTHER PUBLICATIONS

"Inhaltsverzeichnis Cap 947", Protocols for Cellulite Treatments by Means of the Device: CAP 947 of Doove Medical Holand.

* cited by examiner

*Primary Examiner*—Danton D. DeMille
*Assistant Examiner*—Quang D. Thanh
(74) *Attorney, Agent, or Firm*—Browdy and Neimark

(57) ABSTRACT

A apparatus and a method for applying pressure to a human body, the apparatus comprising a compression sleeve with a plurality of inflatable annular cells, a control block with pneumatic valves, and a pressurized fluid source. The most distal cell of the sleeve is designated by number 1, while the most proximal cell is designated by number N. The control block is adapted to perform a regular therapy procedure starting by inflation of the most distal cell or group of cells, and a pre-therapy procedure, preceding the regular therapy procedure, including a succession of cell inflation-deflation subcycles. Each subcycle is performed at least once over a range of at least two adjacent cells, starting with an initial cell different from cell N, progressing towards and ending with cell N. The initial cell of the first subcycle is one of the most proximal one-third of cells, and the initial cell of each next subcycle has a number monotonously and gradually approaching 1.

10 Claims, 3 Drawing Sheets

SYSTEM FOR AND METHOD OF APPLYING PRESSURE TO HUMAN BODY

FIELD OF THE INVENTION

This invention is related to systems of compression therapy, more particularly to pneumatic apparatuses for pressure treatment of edematous conditions.

BACKGROUND OF THE INVENTION

For years it has been common practice to imitate the effects of manual massage by mechanical systems for medical treatments such as treatment of edemas, enhancement of venous return in the extremities, and other various therapies. These systems are commonly referred to as "pneumatic compression therapy".

The commonly used type of such mechanical systems includes a pressure sleeve composed of air or hydraulic cells that can be inflated by various means, a control block with valves and a pressurized fluid source such as a compressor, a pump, or compressed air tank.

U.S. Pat. No. 4,338,923 to Mego Afek describes a pressure therapy system which is designed to exert air pressure in a so-called sequential cycle produced by means of an electromechanical distributor.

A hydraulic system for treating edema is described in U.S. Pat. No. 5,437,610. A programmable control processor operates the valves and the pump of the system and monitors the pressure in the cells. The system can detect an edematous condition by measuring the pressure in prefilled cells. The control processor activates the pump and starts to inflate and deflate the compression cells in a sequential manner to create a wave of compression moving proximally along the extremity.

U.S. Pat. No. 5,830,164 to World Inc. describes an apparatus for treating edema including a sleeve with a plurality of open-ended cells for holding inflatable replaceable bladders, a plurality of electrically operated valves, and a pump. A computer individually controls each valve to pressurize the bladders in variable sequence.

The existing compression systems apply various therapy sequences of cell (bladder) inflation-deflation, such as the peristaltic cycle, or maintain different pressures in a plurality of adjacent cells to obtain pressure gradient with the purpose to move or "squeeze" stagnant bodily fluids proximally, starting each sequence from the most distal cell. However, if in the ailing lymphatic system there are pre-existing blockages, such as blockage of lymph nodes, a compression system may fail to drain the accumulated liquid.

SUMMARY OF THE INVENTION

An apparatus for applying pressure to a human body, according to the present invention, comprises a compression sleeve with a plurality of inflatable annular cells, a control block with pneumatic valves connected to the annular cells, and a pressurized fluid source connected to the control block, the sleeve having an axis, the annular cells being arranged along said axis, the most distal cell being designated by number 1, the most proximal cell being designated by number N, wherein the control block is preprogrammed to perform a regular therapy procedure starting by inflation of the most distal cell or group of cells, and a pre-therapy procedure preceding the regular therapy procedure and including a succession of cell inflation-deflation subcycles performed over a range of at least two adjacent cells, starting with an initial cell different from cell N, progressing towards and ending with cell N, the initial cell of the first subcycle being one of the most proximal one-third of cells, and the initial cell of each next subcycle having a number monotonously and gradually approaching 1.

The apparatus of the present invention is particularly advantageous for compression treatment of edematous conditions as it enables opening blockages of the ailing lymphatic system before initiating the regular pneumatic compression treatment. This is achieved by the control block being preprogrammed to precede the regular therapy procedure by the pre-therapy procedure including a series of compression waves with proximal direction, wherein the first waves originate in a cell near the proximal end of the sleeve and only gradually the initial cell of each successive wave of the series moves more and more distally.

BRIEF DESCRIPTION OF THE DRAWINGS

In order to understand the invention and to see how it may be carried out in practice, an embodiment will now be described, by way of non-limiting example only, with reference to the accompanying drawings, in which.

DETAILED DESCRIPTION OF THE INVENTION

Figure 1:
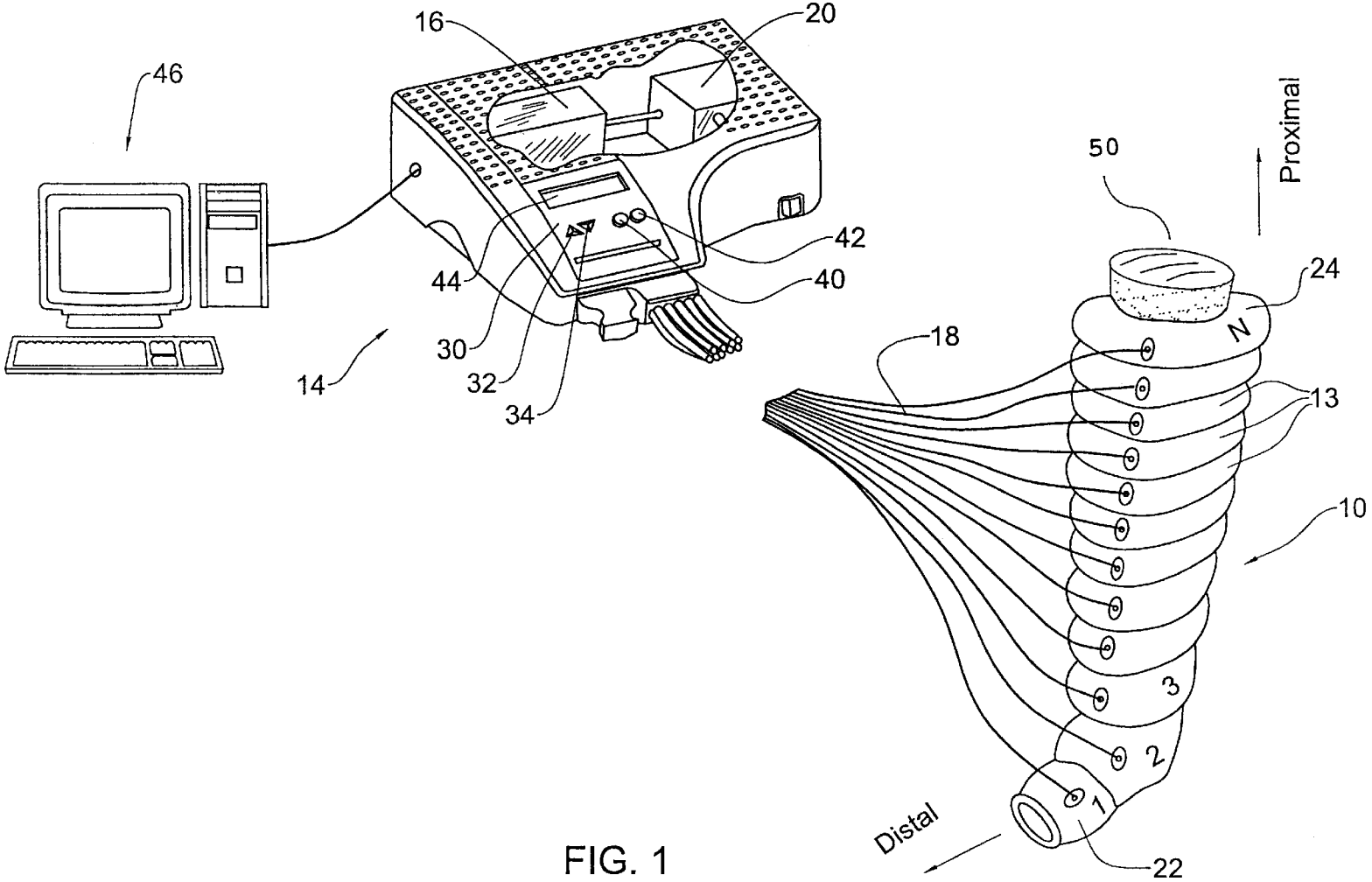
FIG. 1 is a schematic layout of an apparatus for applying pressure, according to the present invention.

With reference to FIG. 1, the compression therapy apparatus of the present invention comprises a compression sleeve 10 with a plurality of inflatable cells 13, an electronic control block 14, as pneumatic system 16 with valves connected by tubes 18 to the cells 13, and a pressurized fluid source 20 connected to the pneumatic system 16.

The compression sleeve 10 has a tubular form with the inflatable cells 13 having an annular shape, or it may be flat, with a plurality of strip-like cells, but adapted to be wrapped around the human body or extremity thereof and fixed thereto assuming essentially the same tubular shape. The inflatable cells 13 are designated 1 to N, the most distal cell 22 being designated by number 1, the most proximal cell 24 being designated by number N.

The control block 14 has a control panel 30 with pressure regulation buttons "Up" 32 and "Down" 34, "Enter/Exit" button 40, "Start/Stop" button 42, and an indicator panel 44. The control block has also pressure sensors, electronic control boards with programmable memory, etc. (not shown here), and is programmed to perform inflation-deflation therapy cycles via the control panel or, optionally, by means of a remote computer 46.

The apparatus operates in the following way. The compression sleeve 10 is wrapped and fixed to an extremity 50 of a patient's body, and inflatable cells 13 are connected to the valves of the pneumatic system 16 by tubes 18.

The operator then performs preparatory routines. Scanning of cells is carried out by applying low pressure to each cell. The scanning detects the number of cells in the sleeve and adjusts the device operation accordingly, the scanning procedure is also used to detect malfunctioning cells. A working cell should display gradual rise of pressure. If the pressure rises immediately or doesn't rise at all, this indicates a blocked cell or broken cell/connection, respectively. Such cell is excluded from the procedure. The operator may also exclude a working cell via the control panel for other reasons, e.g. a painful or sensitive area of the extremity.

As a rule, the pressure sensor in the control block indicates a pressure different from the actual pressure in a cell due to the dynamic inflation-deflation process. For this reason, a special automatic update procedure is performed before the pre-therapy procedure, as necessary.

The operator further chooses, using the control panel 30, or a suitable menu-driven software on the optional computer 46, to perform or not the pre-therapy procedure before the regular therapy procedure, and selects parameters of the regular therapy cycle. The "Start/Stop" button 40 launches the execution of the selected procedures, starting with the pre-therapy procedure.

Figure 2:
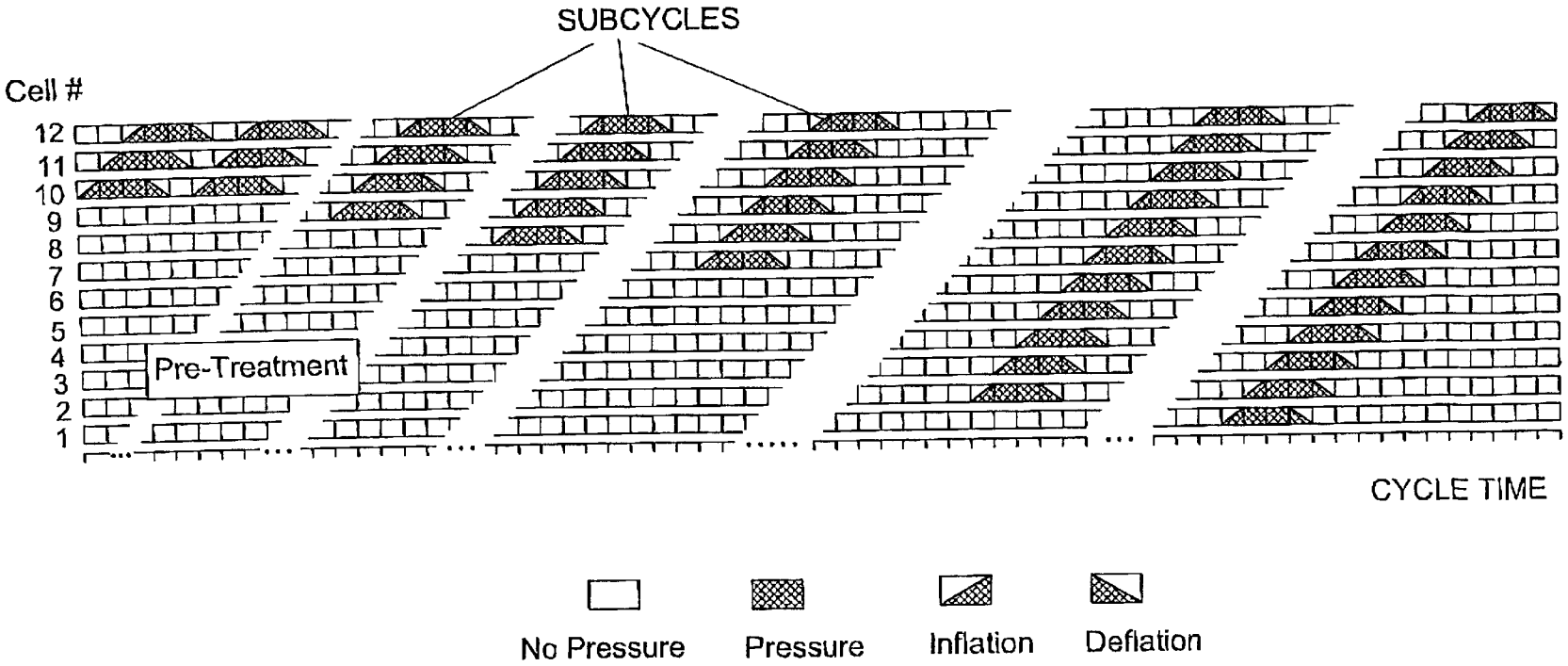
FIG. 2 is a time-pressure diagram of the pre-therapy procedure, according to the present invention, performed by the apparatus shown in FIG. 1.

The pre-therapy procedure of the present invention is explained by the pressure-time diagram in FIG. 2 on the non-limiting example of a sleeve with 12 cells (N=12). The most distal cell of the sleeve is cell No.1, while the most proximal one is cell No. 12. The first subcycle starts with the inflation of initial cell No.10, i.e. N-2, and is thus performed over the range of three cells Nos. 10, 11, and 12. After cell No. 10 is inflated to a desired pressure Pd, the achieved pressure in the cell is maintained, and inflation of cell No. 11 is started. After cell No. 11 is inflated, the achieved pressure Pd is maintained in both cells Nos. 10 and 11, and inflation of cell No. 12 is started. After cell No. 12 is inflated, deflation of cell No. 10 is started, then of cell No. 11, and then of cell No. 12. Thus, at any moment of time, after the inflation of the subcycle initial cell No. 10 and before the deflation of the last cell No. 12, there are two adjacent cells in inflated state.

The second subcycle as can be seen in FIG. 2, is substantially similar to the first one but starts with the inflation of initial cell No. 9 while ending at the same final cell No. 12. Each next subcycle starts with the inflation of an initial cell with a number smaller than the initial cell number of the previous subcycle. The last subcycle will be performed over the whole range of cells from 1 to N (see the rightmost cycle in FIG. 2).

The initial cell of the first subcycle is not necessarily cell No. N-2. It may be cell No. N-1 or another one from the most proximal one-third of cells. In fact, a first subcycle may comprise only inflation-deflation of cell No. N.

Adjacent subcycles may be overlapping (inflation of the next cycle initial cell starting before complete deflation of cell No. N in the previous cycle) or divided by a pause wherein no cell is inflated. The number of adjacent cells which are maintained in inflated state in each moment of a subcycle may be two or more. Each subcycle may be repeated twice or more times, preferably 3 times.

Pressure Pd in each cell may be different, creating a pressure gradient between adjacent cells.

The underlying principle of the pre-therapy procedure is to apply to the body a series of compression waves with proximal direction, wherein the waves start at a cell near the proximal end of the sleeve and gradually encompass the whole range of cells up to the most distal cell. This procedure is effective for opening blockages of the lymphatic system such as blockages of lymph nodes.

Figure 3A:
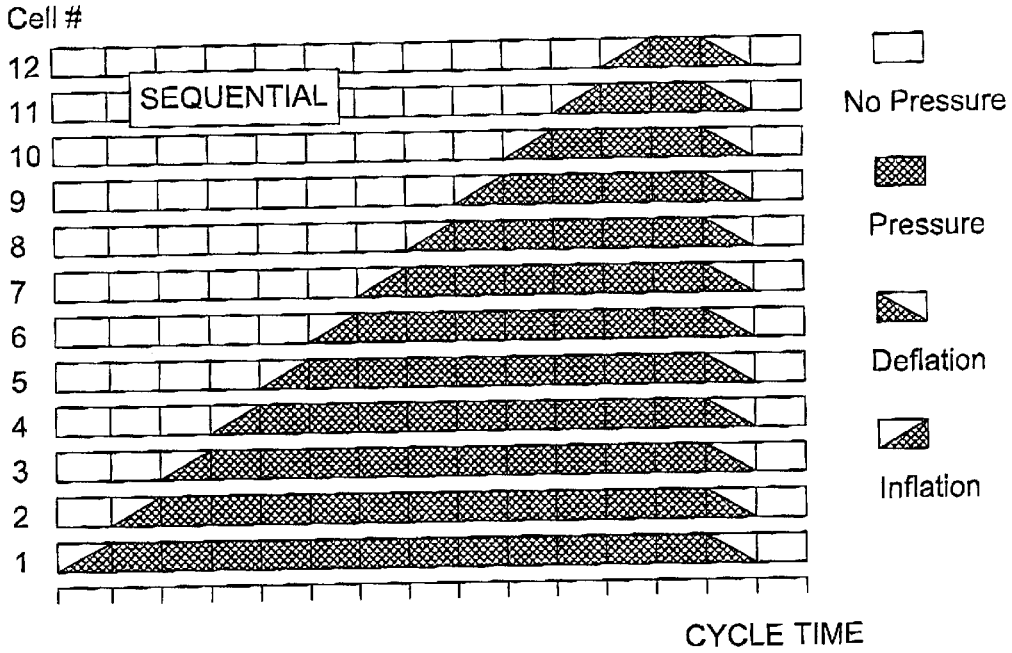
FIGS. 3A and 3B are time-pressure diagrams of basic cycles in two known regular therapy procedures.
Figure 3B:
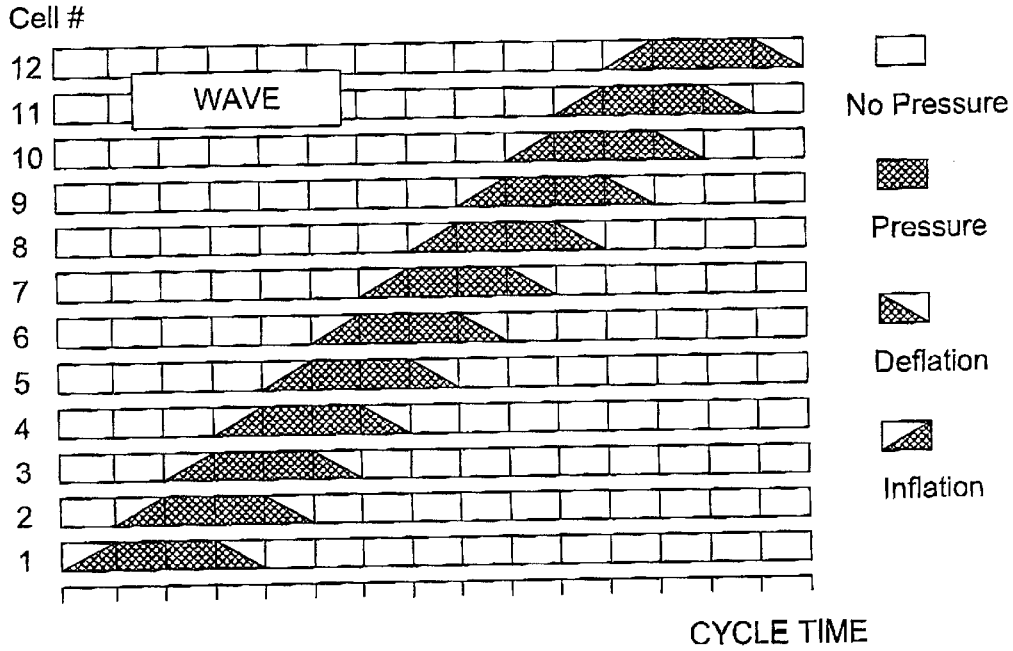

Regular therapy procedures typically comprise one inflation-deflation cycle performed over the whole range of cells Nos. 1 to N, starting at the most distal cell No. 1, and repeated many times for a set time length. Two applicable cycles are shown in FIGS. 3A and 3B under titles "Sequential" and "Wave". One of them is chosen for the actual treatment. The parameters of the regular therapy procedure such as time step duration, inflation control by pressure or by time, inter-cycle pauses, etc. may be adjusted by the operator by means of the control panel 30 or the remote computer 46.

The "Sequential" cycle, FIG. 3A, starts with the inflation of cell No. 1 and a successive inflation of the rest of cells one by one, the inflation proceeding gradually towards cell No. N. All cells are maintained in inflated state until cell No. N is inflated, and then all cells are deflated simultaneously. The pressure can be determined and controlled to be different in each cell, thus creating a pressure gradient between adjacent cells.

The "Wave" cycle, FIG. 3B, is similar to the last subcycle of the pre-therapy procedure (FIG. 2). It starts with the inflation of cell No. 1 and then goes on with a successive inflation of the rest of cells one by one, the inflation proceeding gradually towards cell No. N. The cells are deflated in the same order, but after a certain delay. For example, in FIG. 3 it is shown that the deflation of each cell starts after the next cell is inflated.

It will be understood by a person skilled in the art, that the pre-therapy procedure may be performed in many variations without deviation from the basic principle disclosed herein, and may be applied before any appropriate regular therapy procedure.

What is claimed is:

1. A method of applying pressure to a human body by means of a compression sleeve embracing said human body or extremity thereof, said sleeve having a plurality of inflatable annular cells connected to a control block and a pressurized fluid source, the most distal cell being designated by number 1, the most proximal cell being designated by the number N, the method comprising the steps of a) a pre-therapy procedure including a succession of inflation-deflation subcycles of said annular cells for opening blockages in the human body, wherein each subcycle is performed at least once over a range of at least two adjacent cells, starting with an initial cell different from cell N, progressing towards and ending with cell N, the initial cell of the first subcycle is one of the most proximal one-third of cells, the initial cell of each next subcycle has a number of monotonously and gradually approaching 1; and b) a regular therapy procedure including at least one cycle of inflation and deflation of said annular cells starting by inflation of the most distal cell or group of cells.

2. A method according to claim 1, wherein said inflation-deflation subcycle includes successive steps of inflating an initial cell with number M<N-1 to a desired pressure Pd, inflating an adjacent cell with number M+i, i=1 to the desired pressure Pd, at the same time maintaining the pressure Pd in cell number M, inflating a further adjacent cell with number M+i+2, i=2, to the desired pressure Pd, at the same time maintaining the pressure Pd in cell numbers M+i and deflating cell number M, said steps being repeated with increasing i for numbers of cells M+i until M+i=N.

3. A method according to claim 1, wherein for each subcycle, in each moment after the inflation of the first cell in the subcycle and before the deflation of cell N, at least two adjacent cells are maintained simultaneously in inflated state.

4. A method according to claim 1, for treatment of edematous conditions due to an ailing system, wherein the pre-therapy procedure is intended for initial opening of blockages in the ailing system.

5. A method according to claim 1, wherein during the pre-therapy procedure and/or the regular therapy procedure, said annular cells are selectively inflated until a predetermined pressure is reached.

6. A method according to claim 1, wherein during the pre-therapy procedure and/or the regular therapy procedure, said annular cells are selectively inflated for a predetermined time.

7. A method according to claim 1, wherein adjacent annular cells are inflated to and maintained at different pressures.

8. A method according to claim 4, wherein the ailing system is the lymphatic system or the blood venous system.

9. In a method of compression therapy of edema by means of a compression sleeve having a plurality of inflatable annular cells designated by numbers 1 to N from the most distal to the most proximal cell, a pre-therapy procedure including a succession of inflation-deflation cycles of said annular cells for opening blockages in the human body, wherein each cycle of performed at least once over a range of at least two adjacent cells, starting with an initial cell different from cell N, progressing towards and ending with cell N, the initial cell of the first cycle is one of the most proximal one-third of cells, the initial cell of each next cycle has a number monotonously and gradually approaching 1.

10. A pre-therapy procedure according to claim 9, wherein said inflation-deflation cycle includes successive steps of inflating an initial cell with number $M<N-1$ to a desired pressure Pd, inflating an adjacent cell with number $M+i$, $i=1$ to the desired pressure Pd, at the same time maintaining the pressure Pd in cell number M, inflating a further adjacent cell with number $M+i+2$, to the desired pressure Pd, at the same time maintaining the pressure Pd in cell number $M+i$ and deflating cell number M, said steps being repeated with increasing i for numbers of cells $M+i$ until $M+i=N$.

* * * * *